US006466037B1

(12) United States Patent
Meerpohl et al.

(10) Patent No.: US 6,466,037 B1
(45) Date of Patent: Oct. 15, 2002

(54) METHOD FOR DETERMINING THE LOAD IN A TUMBLE DRYER

(75) Inventors: Hansjörg Meerpohl; Dietmar Pech, both of Berlin (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 0 days.

(21) Appl. No.: 09/138,348

(22) Filed: Aug. 21, 1998

(30) Foreign Application Priority Data

Aug. 21, 1997 (DE) ..... 197 36 422

(51) Int. Cl.[7] ..... G01R 27/08; F26B 11/02
(52) U.S. Cl. ..... 324/695; 34/595; D32/8
(58) Field of Search ..... 324/695, 665, 324/705, 693, 694; D32/8; 34/528, 596, 260, 261, 595

(56) References Cited

U.S. PATENT DOCUMENTS 4,422,247 A * 12/1983 Deschaaf ..... 34/550
5,450,015 A * 9/1995 Mastico et al. ..... 324/665
5,514,973 A * 5/1996 Byler et al. ..... 324/695

FOREIGN PATENT DOCUMENTS

| | | |
|---|---|---|
| DE | 29 45 696 A1 | 5/1981 |
| EP | 0 067 896 A1 | 12/1982 |
| EP | 0 226 209 A2 | 6/1987 |

* cited by examiner

*Primary Examiner*—N. Le
*Assistant Examiner*—James Kerveros
(74) *Attorney, Agent, or Firm*—Laurence A. Greenberg; Werner H. Stemer; Ralph E. Locher

(57) ABSTRACT

A method for determining a load in a tumble dryer. Laundry in the tumble dryer is moved in a drum. The electrical conductivity of the laundry is determined by electrodes which touch the laundry at least from time to time resulting in a measurement signal. The electrical conductivity measurement signal exhibits pulses because of the changes in the determined conductivity of the laundry. The changes occurring during the movement of the laundry in the drum. The frequency of the pulses of the measurement signal of the conductivity is determined and serves as a measure of the load in the tumble dryer. As a result, the measure of the load is made available having a high accuracy and in a digital form. The digital form of the load is particularly advantageous for further processing in digital components.

16 Claims, 1 Drawing Sheet

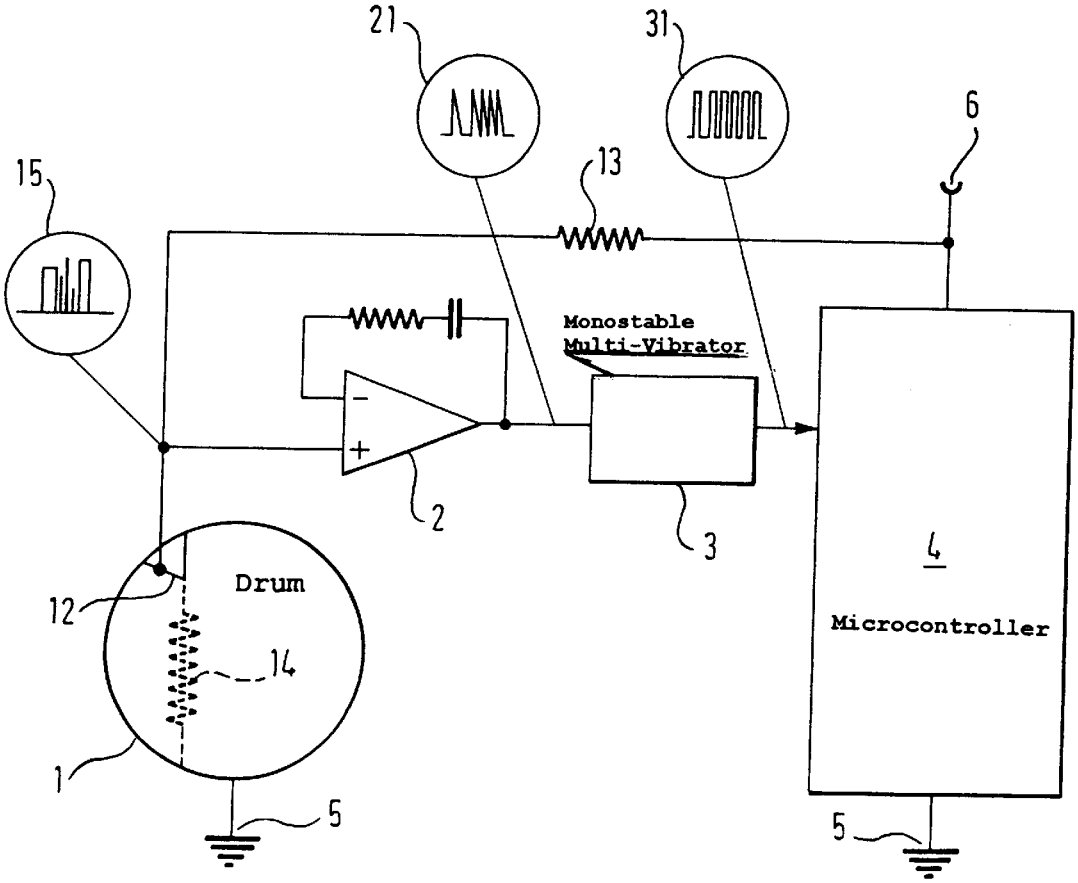
21
31
6
15
13
Monostable
Multi-Vibrator
2
3
4
Microcontroller
Drum
12
14
1
5
5

METHOD FOR DETERMINING THE LOAD IN A TUMBLE DRYER

BACKGROUND OF THE INVENTION

Field of the Invention

The present invention relates to a method for determining a load in a tumble dryer. The tumble dryer is provided with electrodes for determining the electrical conductivity of laundry in the tumble dryer.

During the drying operation, in addition to the moisture and the type of laundry, which is usually dried in a drum, among other factors, the load in the tumble dryer also plays a major part in the drying process. It is therefore advantageous for various reasons to determine the load in the tumble dryer, for example in order to predict the remaining time accurately, in order to control the drying process in an optimum fashion or in order to output a heating capacity that is matched to the heating requirement.

The prior art discloses methods of determining the load in tumble dryers which are based on the evaluation of temperature measurements or temperature gradient measurements, on the current demand of the motor to move the laundry drum or on a measurement of the electrical capacitance of the drum.

Furthermore, a method for determining the load in tumble dryers in which the electrical conductivity of the laundry is used is disclosed in Published, Non-Prosecuted German Patent Application DE 29 45 696 A1. According to that document, the drum is fitted with two electrodes, which touch the laundry from time to time as the drum rotates and by which the electrical conductivity of the laundry is determined. The conductivity signal, which varies with the movement of the laundry in the drum and exhibits pulses, is connected to a threshold-value circuit. The conductivity signal indicates that there is a piece of laundry resting on the electrodes, even in the dry state, by outputting a hit signal of a constant level which is subsequently integrated. The more frequently and the longer a piece of laundry is resting on the electrodes, the more frequent and longer are the hit signals and the higher is the value of the integral of the hit signals. The integral of the hit signals therefore constitutes a measure of the load in the tumble dryer, which can be used for controlling the drying process.

However, the above-described method has disadvantages. The integration of an intrinsically digital hit signal results in a fall-back to an analog signal, which cannot be processed further using digital components. In modern tumble dryers, digital modules, in particular microcontrollers, are preferably used for control, so that an analog signal to be processed disadvantageously requires an increased outlay. Thus, the processing of an analog signal by a digital module entails an additional outlay in circuitry for the analog/digital conversion.

Furthermore, in the case of laundry which is very dry and has a low conductivity, the use of a simple threshold value circuit may give rise to the situation where, as a result of the low conductivity difference between a contact and a non-contact measurement of a piece of laundry engaging the electrodes, it may not be possible to register the contact of the laundry.

SUMMARY OF THE INVENTION

It is accordingly an object of the invention to provide a method for determining a load in a tumble dryer which overcomes the above-mentioned disadvantages of the prior art methods of this general type, in which a measure of the laundry load, using digital modules, is easy to further process, and a more reliable determination of the load is made possible even in the case of pieces of laundry having very low conductivity.

With the foregoing and other objects in view there is provided, in accordance with the invention, a method for determining a load in a tumble dryer, which includes: moving laundry in a laundry drum having electrodes; generating a pulsed conductivity measurement signal measuring electrical conductivity of the laundry as a result of contact occurring at least from time to time between the laundry and the electrodes of the laundry drum; and determining a frequency of the pulsed conductivity measurement signal, the frequency serving as a measure of a load of the laundry.

According to the invention, the frequency of the pulses in the measurement signal of the electrical conductivity of the laundry is determined and used as a measure of the load. The higher the frequency, the more frequently a piece of laundry touches the electrodes, and the greater is the load of the laundry in the dryer. This achieves the situation where the measure of the load is present in digital form, which significantly simplifies further processing with digital modules, in particular microcontrollers. The load can then be taken into account for controlling the drying process.

Advantageously, the signal edges of the conductivity measurement signal are registered in particular by forming a time derivative (differentiation), and the frequency of the conductivity measurement signal is determined by determining the frequency of the registered edges. By registering the edges of the conductivity measurement signal, independent of its absolute level, the conductivity of the laundry is determined. Thus, a reliable determination of the load is possible even in the case of laundry of very low conductivity.

According to a further advantageous embodiment, the pulses of the conductivity measurement signal are compared with a threshold value and, by counting the pulses above or below a specific threshold value per unit of time, the frequency of the pulses which fall above or below the threshold value is determined. Since the comparison with a threshold value can be implemented particularly simply in terms of circuitry by using a comparator or a Schmitt trigger, it is possible in implement the invention in a particularly simply and cost-effectively manner.

Advantageously, either the registered edges of the conductivity measurement signal or, if appropriate, the fact that a conductivity measurement signal falls above or below a threshold value, in each case triggers a pulse of constant duration. The frequency of the pulses are then determined and used as a measure of the load. The triggering pulses of constant duration avoids the occurrence of extremely short or extremely long pulses which make a reliable determination of the load more difficult in the case of a limited reaction time capability of the components.

In a particularly advantageous way, the determination of the frequency of the pulses of the conductivity measurement signal is carried out by a microcontroller. This enables the frequency to be determined with a low outlay for components and, as the central control device in the tumble dryer, the microcontroller can directly use the necessary information about the load.

Furthermore, each of the above-mentioned steps in the course of processing the conductivity measurement signal in order to determine the frequency of its pulses can advantageously also be implemented in a digital electronic arithmetic unit or a microcontroller. The fact that the function is carried out in a microcontroller that is already present in the dryer results in a savings in components and circuitry, which also leads to a lower probability of failure of the tumble dryer.

Thus, as already mentioned, the determination of the frequency of the pulses of the conductivity measurement signal, but also the determination of all other frequencies serving as a measure of the load, can be carried out particularly advantageously with the microcontroller. The frequency measurement, of whatever pulses or events, can be carried out with a very low outlay on circuitry and very high accuracy using the microcontroller, since the latter, in comparison with analog circuits, is able to process just the digital signals particularly advantageously.

The comparison of the conductivity measurement signal with a predetermined threshold value may be carried out particularly advantageously with the microcontroller. For this purpose, it is possible to use an analog/digital convertor that is assigned to the microcontroller or implemented in it or else a special input to the microcontroller, such as an input with a Schmitt trigger or comparator, which can execute the comparison function.

In the case of several embodiments, if a microcontroller is used, that has to process analog signals, which is possible only with an interposed analog/digital convertor, the analog/digital convertor may be assigned externally to the microcontroller or else integrated in the microcontroller. If use is made of a microcontroller with an associated analog/digital convertor, all of the previously mentioned methods can be carried out as a result of the capability of processing both the analog and digital signals, so that it is also possible for a plurality of the above-mentioned methods to be applied in the tumble dryer.

Other features which are considered as characteristic for the invention are set forth in the appended claims. Although the invention is illustrated and described herein as embodied in a method for determining the load in a tumble dryer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The FIGURE of the drawing a block circuit diagram of a structure for carrying out one embodiment of the method according to the invention.

DESCRIPTION OF THE PREFERRED EMBODIMENTS

Referring now to the single FIGURE of the drawing in detail, there is shown a drum 1 with a first electrode 12, the drum 1 itself serving as a second electrode. In order to obtain the conductivity of laundry, the drum 1 is connected to a ground 5 of the tumble dryer, and the first electrode 12 is connected via a bias resistor 13 to a constant voltage 6. The laundry in the drum 1 has a laundry resistance 14, which on one side is connected via the drum 1 to the ground 5 of the tumble dryer. On the other side, the laundry is connected via the electrode 12 to the resistor 13, and therefore forms a voltage divider with the latter. At the junction between the laundry resistance 14 and the bias resistor 13, a measured signal 15 is obtained which serves as a measure of the conductivity of the laundry. The measured conductivity signal 15 is connected to an input of a differential element 2, which generates an output signal 21. The output signal 21 from the differential element 2 is in turn connected to an input of a monostable multivibrator 3, whose output signal 31 is connected to an input of a microcontroller 4.

The load in the tumble dryer is determined during the movement of the laundry in the drum 1 as a result of its rotation. During the rotation, the laundry touches the first electrode 12, at least from time to time, which results in the measured conductivity signal 15 that varies with time. Each time a piece of laundry touches the first electrode 12, or each time the laundry resistance 14 measured between the first electrode 12 and the drum 1 changes, the measured conductivity signal 15 will exhibit a jump or a pulse. Thus, the number of the pulses per unit of time is a measure of the load in the tumble dryer. Since the measured conductivity signal 15 is very irregular, and the determination of the frequency of the pulses is difficult, the signal must be suitably conditioned. For this purpose, the slope of the pulses of the measured conductivity signal 15 is determined, and thus that of its flanks is registered, using the differential element 2. Each of the registered edges, which are contained in the output signal 21 from the differential element 2, triggers the monostable multivibrator 3 to output a pulse signal 31 of constant duration. The output signal 31 from the monostable multivibrator 3, which exhibits the pulses of constant duration, is connected to a digital input of the microcontroller 4. The microcontroller 4 counts the pulses received per unit of time in the signal 31 and thus determines the frequency, which is a direct measure of the load.

Thus, the novel solution provides a method for determining the load in a tumble dryer with which the measure of the load is present in digital form. As a result, simpler processing by digital modules, in particular by the microcontroller 4, and a more precise determination of the load are possible. In the case of using the microcontroller 4 for controlling the drying operation, it is in this way possible for the necessary information about the load to be directly available in the microcontroller 4.

We claim:

1. A load determining method for a tumble dryer, which comprises:

moving laundry in a laundry drum of a tumble dryer, the laundry drum having electrodes;

generating a pulsed conductivity measurement signal measuring electrical conductivity of the laundry as a result of contact occurring at least from time to time between the laundry and the electrodes of the laundry drum; and determining a frequency of the pulsed conductivity measurement signal, the frequency serving as a measure of a load of the laundry.

2. The method according to claim 1, which comprises:

registering edges of the pulsed conductivity measurement signal; and determining a frequency of the registered edges, the frequency serving as the measure of the load.

3. The method according to claim 2, which comprises using each of the registered edges to trigger a pulse having a constant duration for forming a pulse train, and determining a frequency of the pulse train, the frequency of the pulse train serving as the measure of the load.

4. The method according to claim 2, which comprises performing the registration of the edges of the pulsed conductivity measurement signal step and the determination of the frequency of the registered edges step with a microcontroller.

5. The method according to claim 2, which comprises registering the edges of the pulsed conductivity measurement signal by deriving time derivatives (differentiation) of the edges.

6. The method according to claim 3, which comprises performing the registration of the edges of the pulsed conductivity measurement signal step, the triggering of the pulse of constant duration step, and the determination of the frequency of the pulse train step with a microcontroller.

7. The method according to claim 1, which comprises comparing pulses of the pulsed conductivity measurement signal with a threshold value, and determining a frequency of the pulses exceeding the threshold value.

8. The method according to claim 7, which comprises triggering a pulse of a constant duration for each instance that a pulse of the pulsed conductivity measurement signal exceeds the threshold value for forming a pulse train, and determining a frequency of the pulse train, the frequency of the pulse train serving as the measure of the load.

9. The method according to claim 7, which comprises performing the comparison of the pulses of the pulsed conductivity measurement signal with the threshold value step, and the determination of the frequency of the pulses exceeding the threshold value step with a microcontroller.

10. The method according to claim 8, which comprises performing the comparison of the pulsed conductivity measurement signal with the threshold value step, the triggering of the pulse of constant duration step, and the determination of the frequency of the pulse train step with a microcontroller.

11. The method according to claim 1, which comprises comparing pulses of the pulsed conductivity measurement signal with a threshold value, and determining a frequency of the pulses falling below the threshold value.

12. The method according to claim 11, which comprises triggering a pulse of a constant duration for each instance that a pulse of the pulsed conductivity measurement signal falls below the threshold value for forming a pulse train, and determining a frequency of the pulse train, the frequency of the pulse train serving as the measure of the load.

13. The method according to claim 11, which comprises performing the comparison of the pulses of the pulsed conductivity measurement signal with the threshold value step, and the determination of the frequency of the pulses falling below the threshold value step with a microcontroller.

14. The method according to claim 12, which comprises performing the comparison of the pulsed conductivity measurement signal with the threshold value step, the triggering of the pulse of constant duration step, and the determination of the frequency of the pulse train step with a microcontroller.

15. The method according to claim 1, which comprises performing the determination of the frequency step with a microcontroller.

16. The method according to claim 15, which comprises providing an analog/digital convertor connected to the microcontroller for processing analog signals.

* * * * *